US011603712B2

(12) United States Patent
Fox

(10) Patent No.: US 11,603,712 B2
(45) **Date of Patent: *Mar. 14, 2023**

(54) DOWNHOLE MCEI INDUCTIVE COUPLER WITH HELICAL COIL

(71) Applicant: Joe Fox, Spanish Fork, UT (US)

(72) Inventor: Joe Fox, Spanish Fork, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/567,110

(22) Filed: Jan. 1, 2022

(65) Prior Publication Data

US 2022/0120143 A1 Apr. 21, 2022

(51) Int. Cl.
*E21B 17/02* (2006.01)
*E21B 17/00* (2006.01)
*E21B 17/20* (2006.01)

(52) U.S. Cl.
CPC ..... *E21B 17/028* (2013.01); *E21B 17/003* (2013.01); *E21B 17/206* (2013.01)

(58) Field of Classification Search
CPC .. E21B 17/003; E21B 17/028; E21B 17/0283; E21B 17/0285; E21B 17/206
See application file for complete search history.

(56) References Cited

U.S. PATENT DOCUMENTS

2002/0193004 A1* 12/2002 Boyle ..... E21B 17/0283 439/577
2007/0159351 A1* 7/2007 Madhavan ..... E21B 17/003 340/855.1
2022/0122768 A1* 4/2022 Fox ..... H01F 27/2885
2022/0157517 A1* 5/2022 Fox ..... H01F 27/363

* cited by examiner

*Primary Examiner* — D. Andrews

(57) ABSTRACT

A downhole data transmission system comprising a composite polymeric annular block including a ferrite channel molded therein. The block being suitable for being housed within an annular groove or trough in the shoulder of a drill pipe. The annular block comprising a volume of sub-micron and micron elements of Fe and Mn. The ferrite channel defining an annular core region and an insulated helical coil laying within the core region. One end of the insulated helical coil passing through the ferrite channel and the annular block. A gasket molded into the block and extending from the block provides a sealed pathway for the end of the coil to exit the groove and connect to a cable; the other end of the coil being connected to ground. The annular block further includes a bumper protruding from its peripheral wall and a void opening within the annular block proximate the bumper.

20 Claims, 15 Drawing Sheets

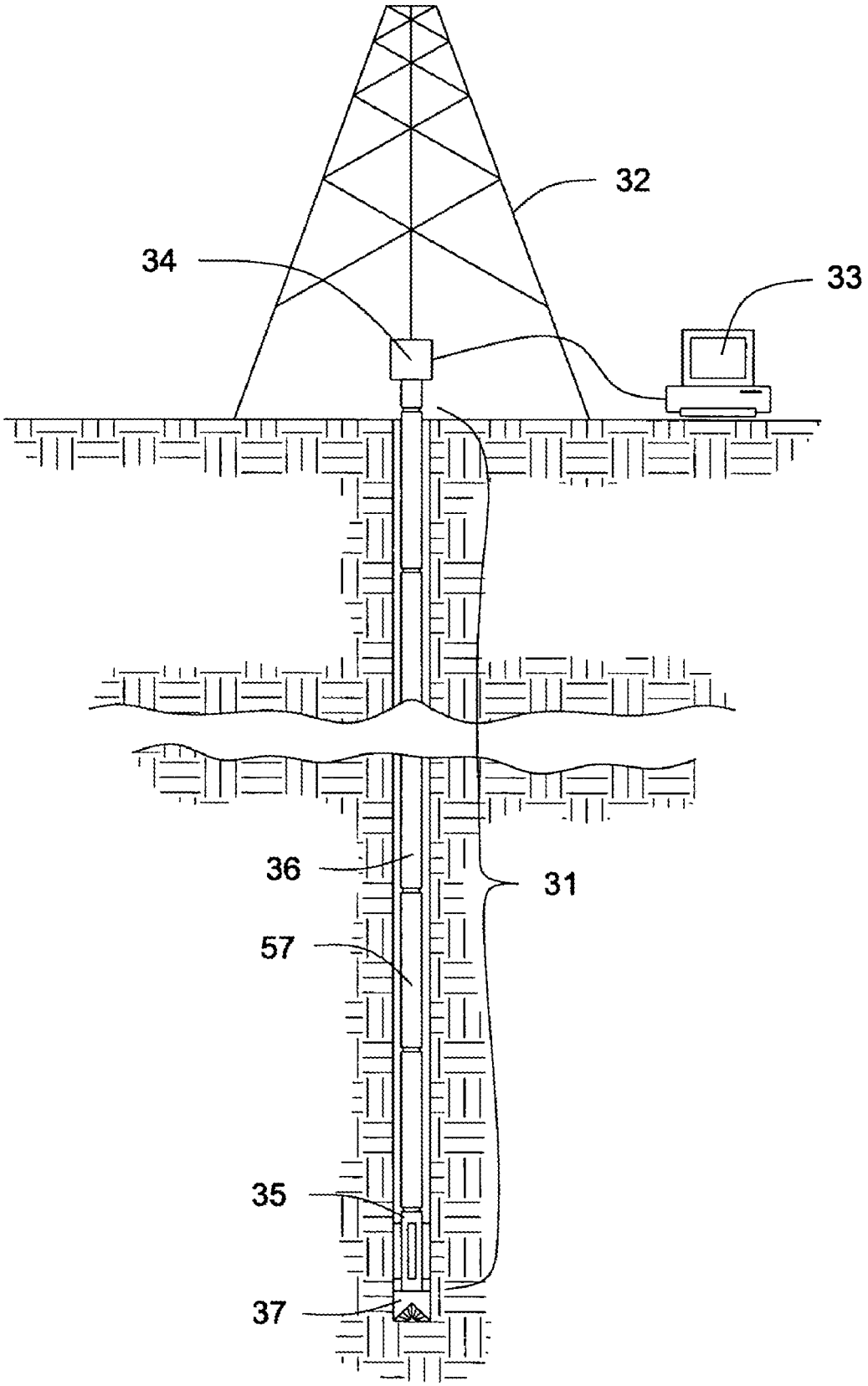
(Prior Art) FIG. 3

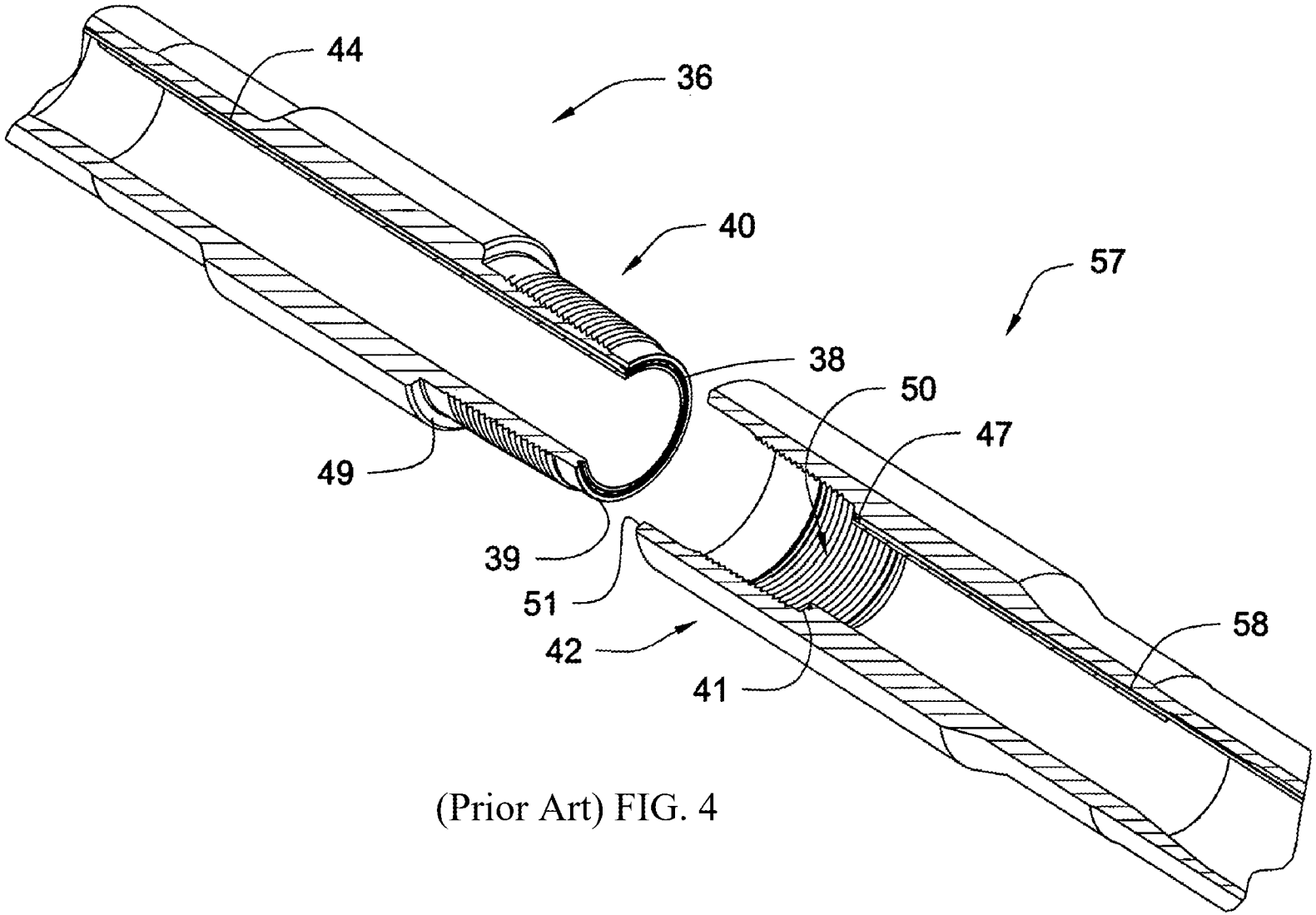
(Prior Art) FIG. 4

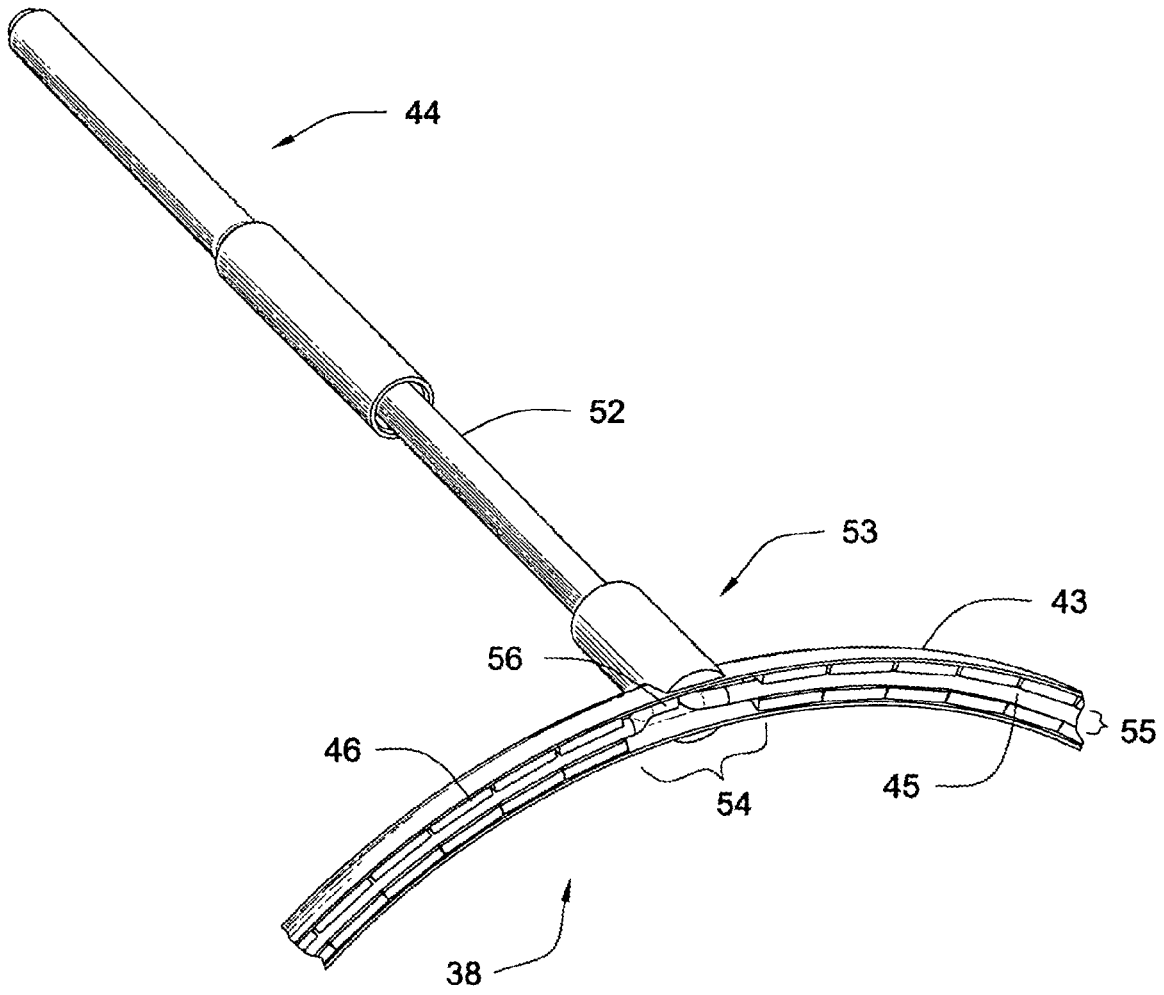
(Prior Art) FIG. 5

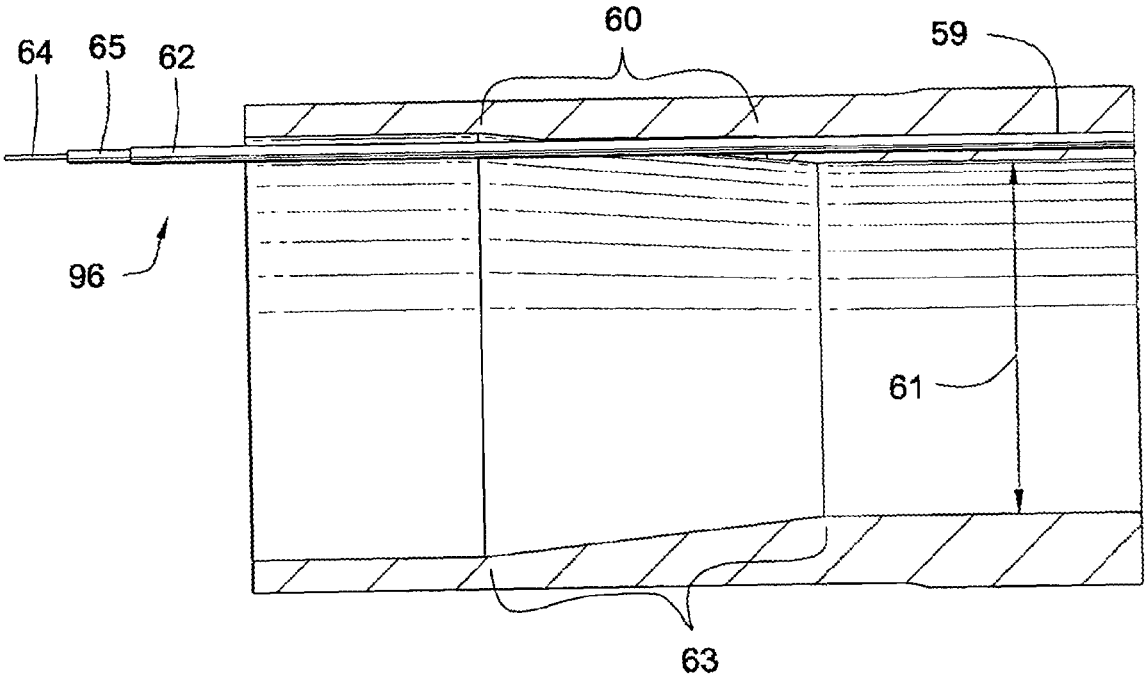
(Prior Art) FIG. 6

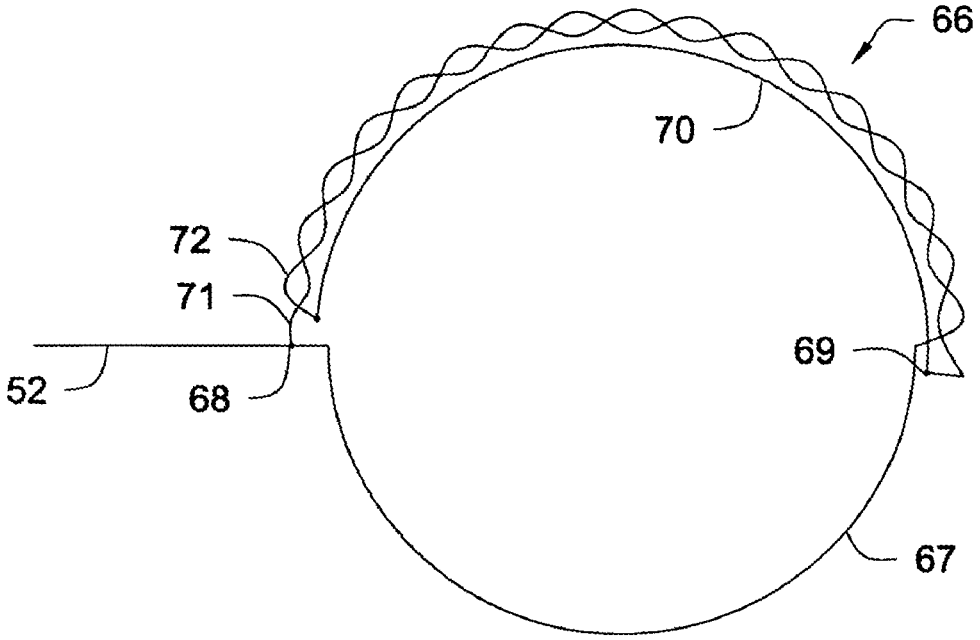
(Prior Art) FIG. 7
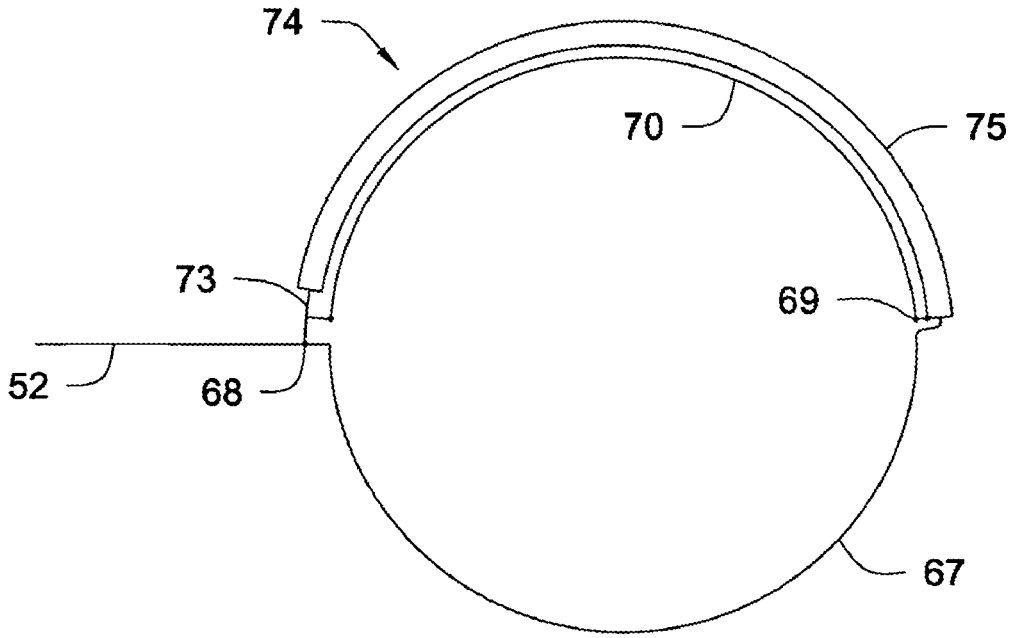
(Prior Art) FIG. 8

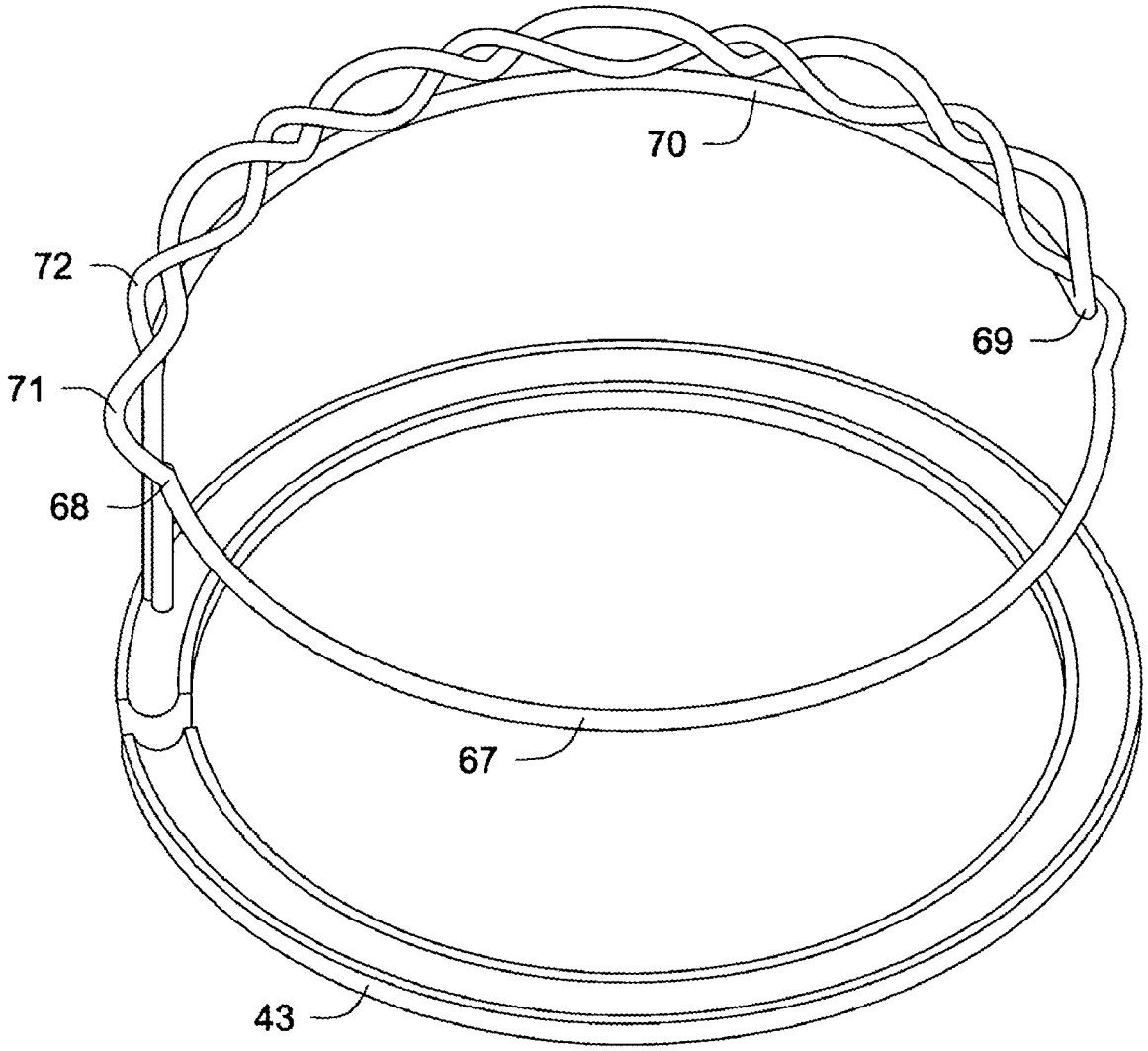
(Prior Art) FIG. 9

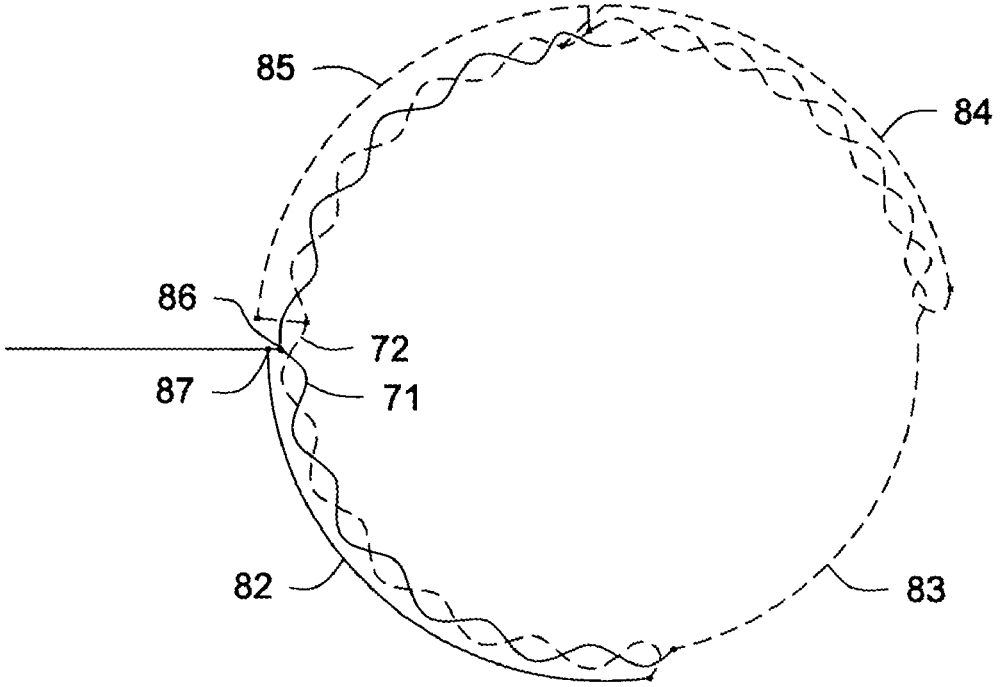
(Prior Art) FIG. 10
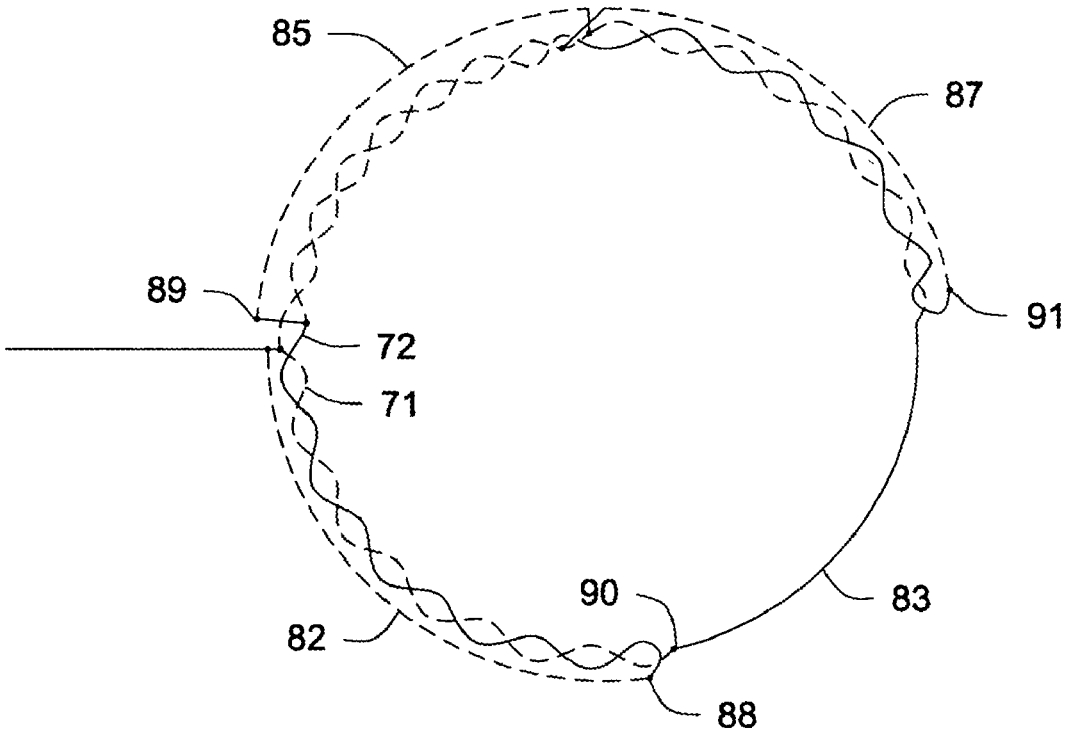
(Prior Art) FIG. 11

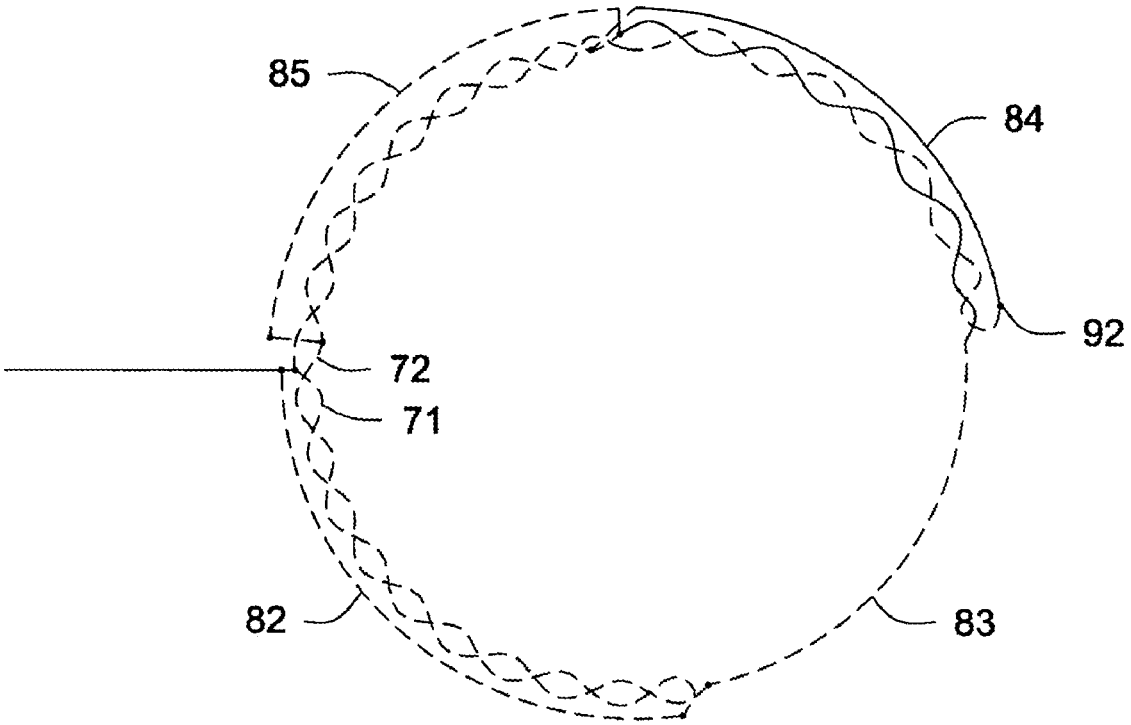
(Prior Art) FIG. 12
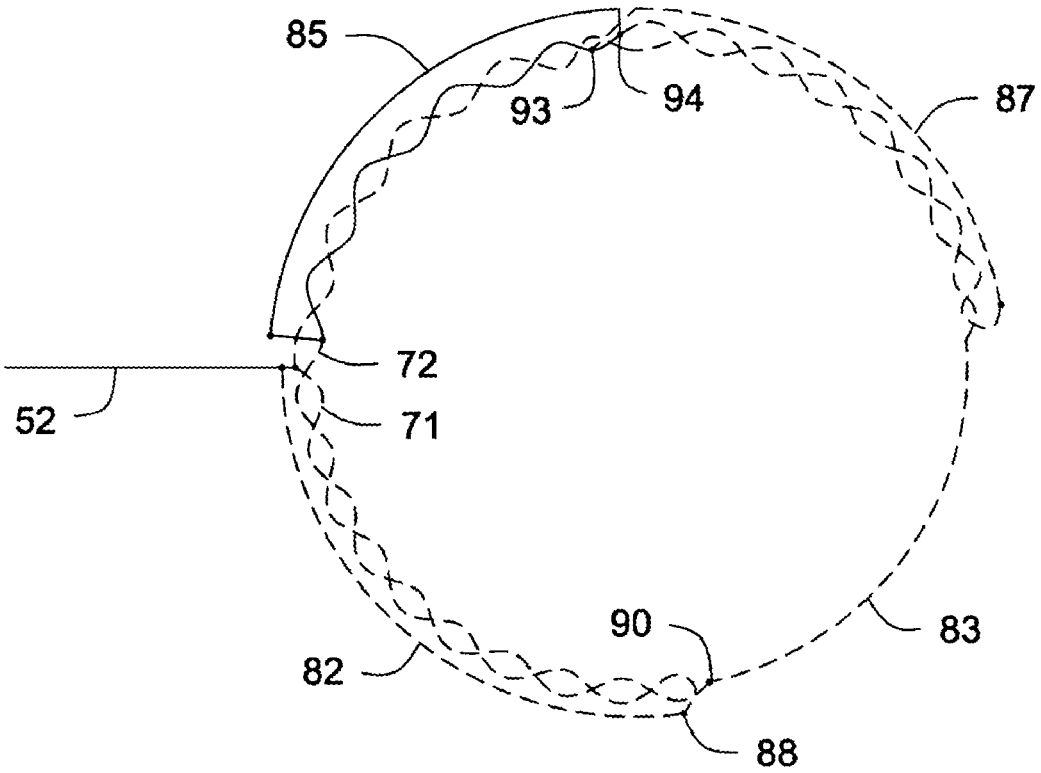
(Prior Art) FIG. 13

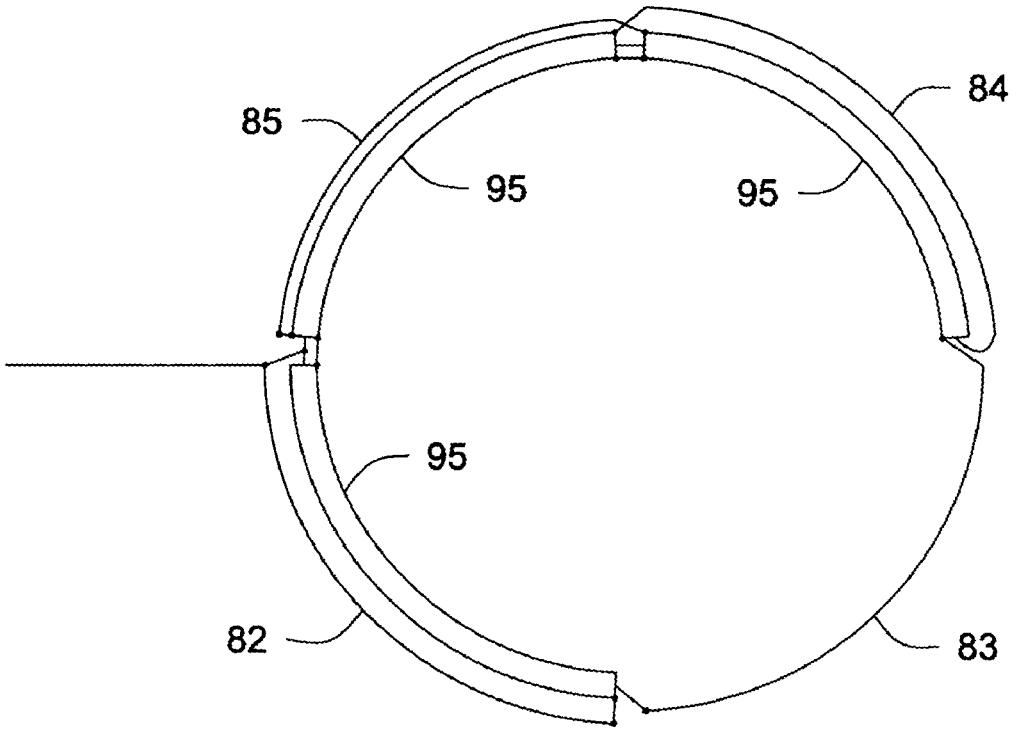
(Prior Art) FIG. 14
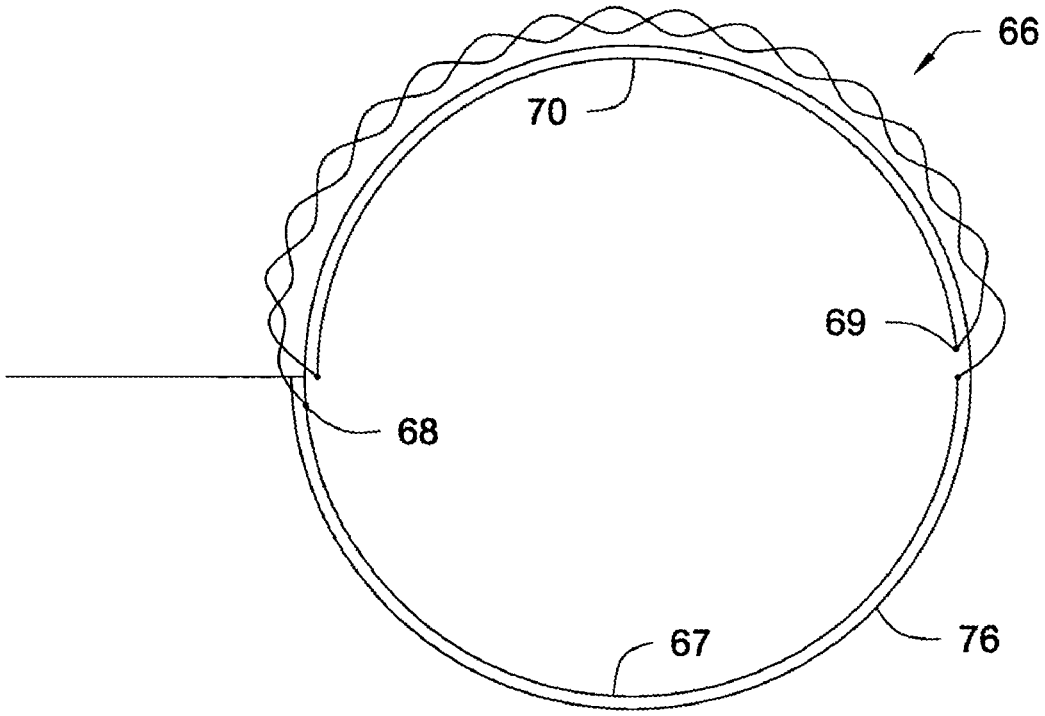
(Prior Art) FIG. 15

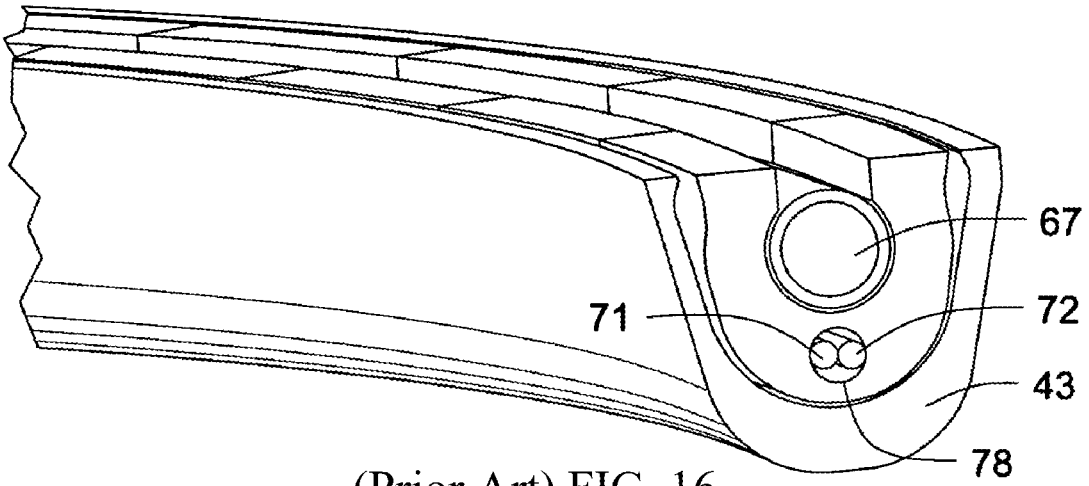
(Prior Art) FIG. 16
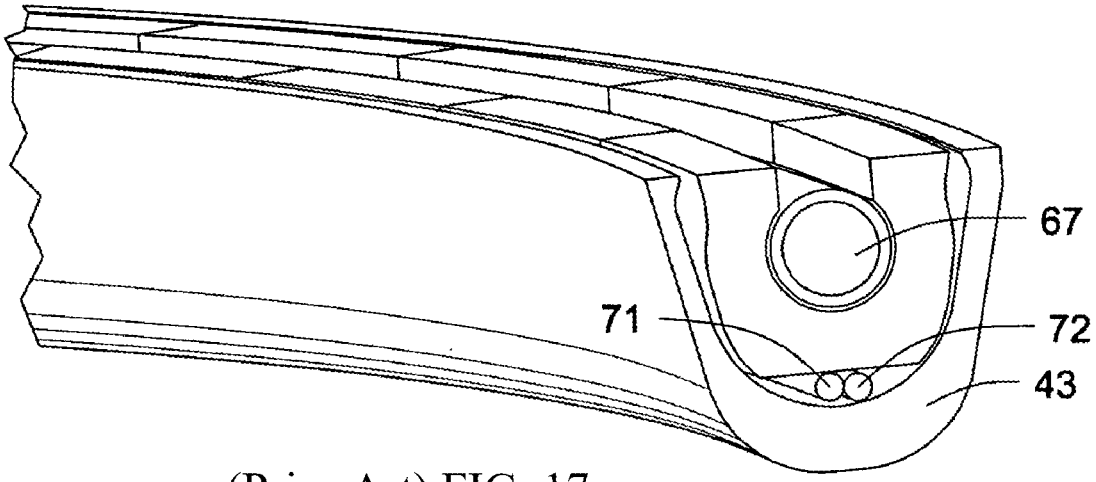
(Prior Art) FIG. 17
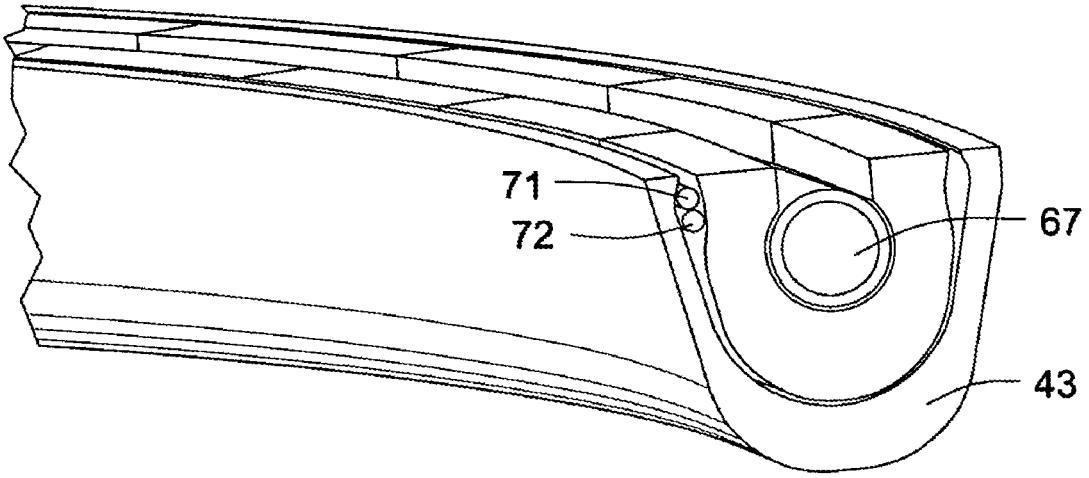
(Prior Art) FIG. 18

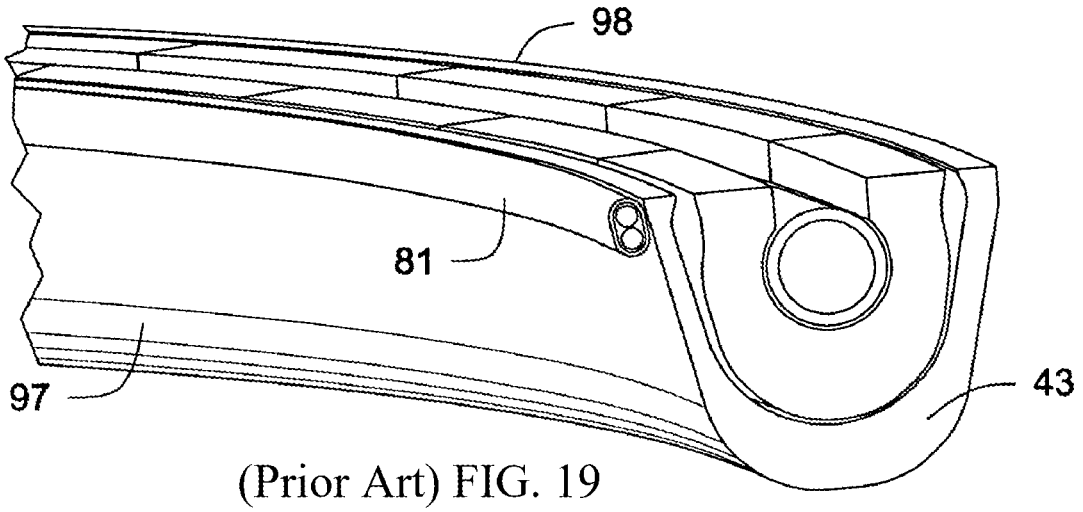
(Prior Art) FIG. 19
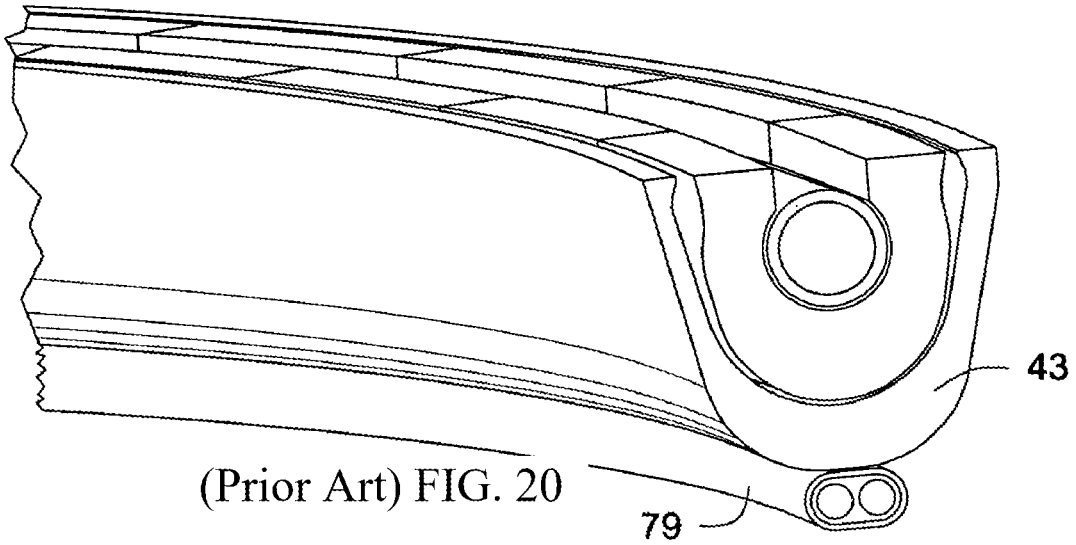
(Prior Art) FIG. 20
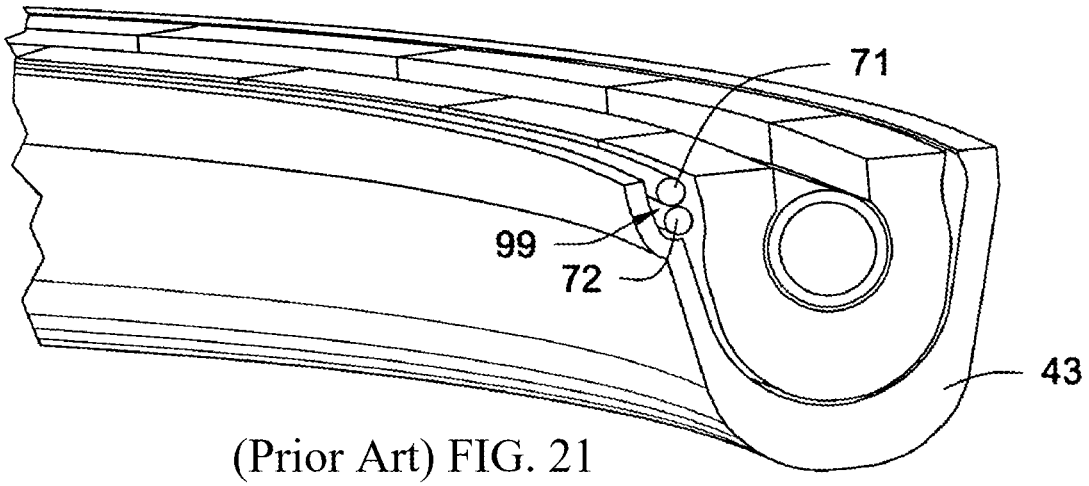
(Prior Art) FIG. 21

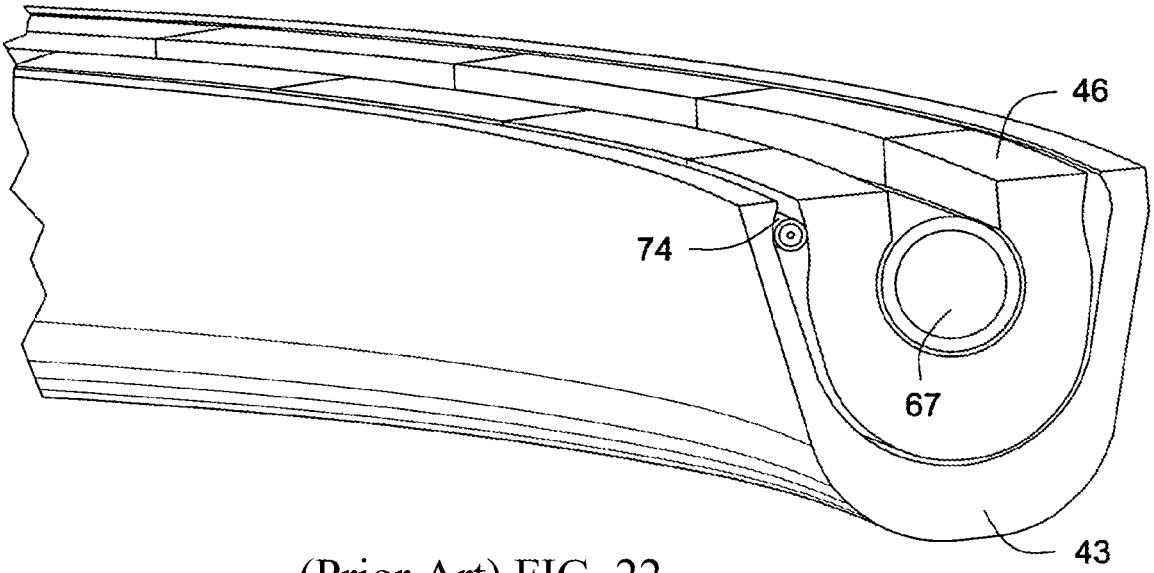
(Prior Art) FIG. 22
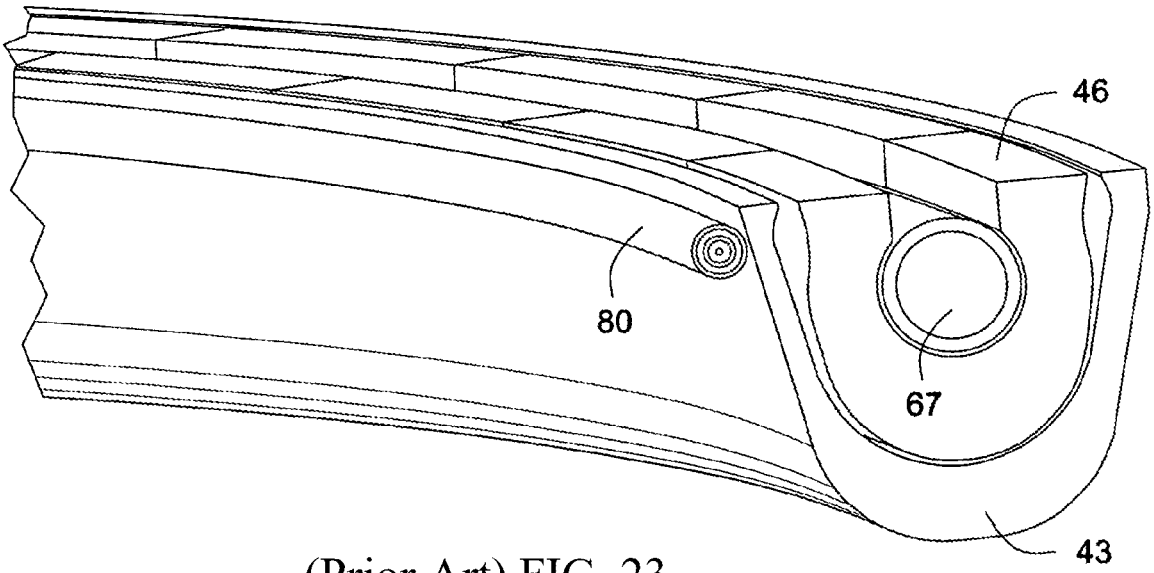
(Prior Art) FIG. 23

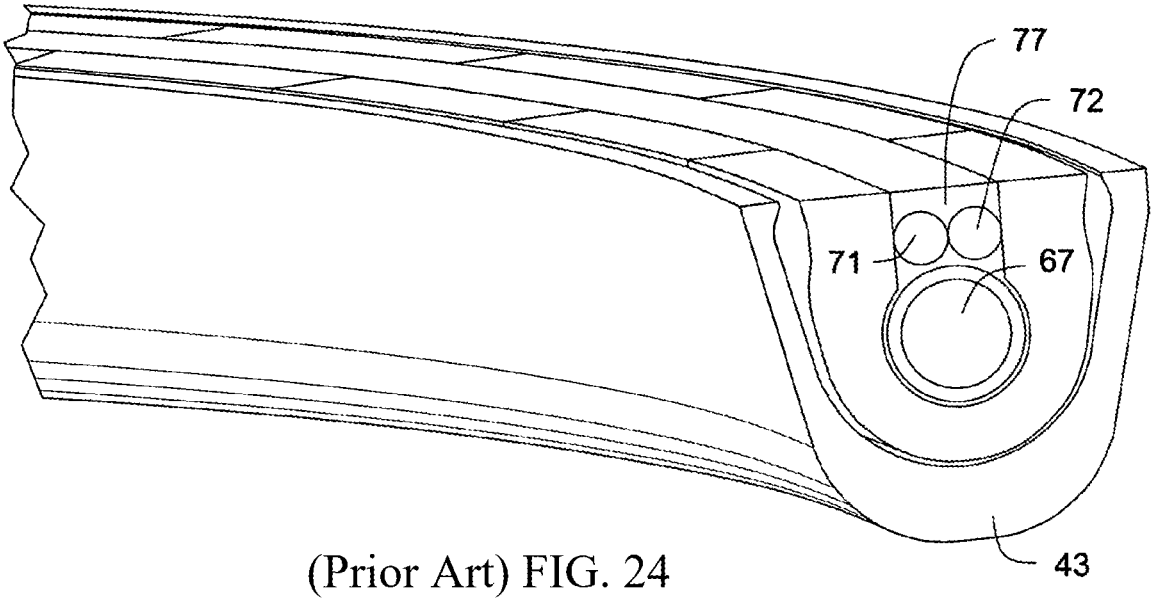
(Prior Art) FIG. 24
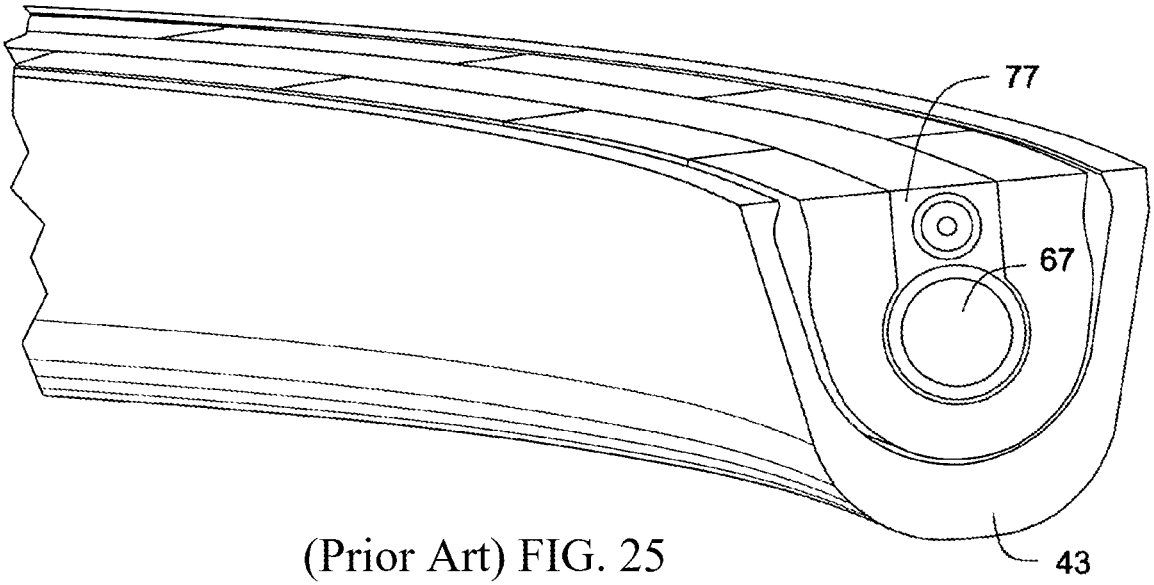
(Prior Art) FIG. 25

DOWNHOLE MCEI INDUCTIVE COUPLER WITH HELICAL COIL

This disclosure presents modifications and alterations to U.S. Pat. No. 7,248,177, to Hall et al., issued Jul. 24, 2007, entitled Downhole Transmission System, the entirety of which is incorporated herein by this reference. A portion of the text of this application related to the summary, detailed description, and prior art figures is largely taken from said '177 reference.

BACKGROUND

Additionally, U.S. Pat. No. 11,033,958, to Imaoka et al., issued Jun. 15, 2021, entitled Magnetic Material and Manufacturing Method Therefore, is incorporated herein by this reference.

High speed data communication with downhole tools is essential for the construction of modern oil and gas wells. Because of the harsh environment encountered downhole, the electronic equipment used in data communication must be extremely reliable and capable of overcoming the moisture, noise, vibrations, high temperatures, and rough handling incident to deep well drilling. Wired drill pipe (WDP) has in many respects risen to meet the challenges presented in the construction of oil and gas wells. The inductive coupling of drill pipe joints along the drill string enables high speed data communication between downhole tools and the surface drillers. Presented in this application, is an alteration and modification of the inductive coupler prior art disclosed and incorporated into the '177 reference.

SUMMARY OF THE INVENTION

The following summary is related to FIGS. 1 and 2 disclosing the modifications and alterations to the underlying prior art as incorporated into the '177 reference.

A data transmission system for wired drill pipe (WDP) is disclosed comprising a composite annular polymeric block suitable for housing in an annular groove in a shoulder of a drill pipe. The composite annular polymeric block may comprise an annular magnetically conductive electrically insulating (MCEI) ferrite channel (or trough in the '177 reference) molded therein. A helical electrical conductor, for example a copper wire, comprising a plurality of vertical loops may be disposed within the ferrite channel or trough. One end of the helical electrical conductor may be connected to a cable running the length of the drill pipe and connected to a similarly configured helical electrical conductor at the opposite end of the drill pipe. The other end of the helical electrical conductor may be connected to ground, for example the drill pipe shoulder.

The ferrite channel or trough may comprise a core region open on its top side. The core region may be circular or non-circular in shape. The vertical loops of the helical conductor may be constrained within the core region. The major diameter of the vertical loops may be less than the major diameter of the core region. The diameter of the vertical loops may be equal to between ten percent and ninety percent of the diameter of the core region. The open portion of the core region may be filled with a composite material. The composite material may comprise a material similar to the polymeric block. The top surface of the ferrite channel defining the open portion of the core region may be exposed along the top surface of the annular polymeric block. The plurality of vertical loops may average between 2 and 60 loops per linear inch within the core region of the ferrite channel. The annular channel may house 300 or more vertical loops depending on the largest circumference of the annular channel. The vertical loops may comprise an insulating coating or sheath. The core region may be filled with a non-electrically conducting material or the core region may be devoid of a filler.

The composite polymeric block may comprise a polymer selected from the group consisting of epoxy, synthetic rubber, polyurethane, silicon, a fluorinated polymer, polytetrafluoroethylene, perfluoroalkoxy, or a combination thereof. The composite polymeric block may comprise a volume of particles comprising micron and submicron elements of Fe and Mn of diameters averaging between 150 nm and 2500 nm. The volume of particles may average between three percent and sixty-seven percent of the volume of the polymer.

The composite polymeric block may comprise one or more protruding bumpers along its peripheral side. Or the protruding bumper may circumscribe the periphery of the polymeric block. The bumper may comprise a dimple on its anterior surface. The protruding bumper may be aligned with a bumper seat disposed in an adjacent wall of the annular groove in the drill pipe shoulder.

The composite polymeric block may comprise one or more void openings within the composite polymeric block. A void opening within the polymeric block may be located proximate the protruding bumper. The presence of the void opening proximate the protruding bumper may provide resiliency in the polymeric block as the block is installed into the annular groove.

The composite polymeric block may comprise a gasket molded therein. The gasket may comprise an axial opening. The gasket may protrude from the composite polymeric block. The axial opening may provide a pathway for the helical wire to exit the polymeric block on its way to connect with the cable. The gasket may be disposed within a gasket seat in the drill pipe shoulder adjacent the polymeric block. The gasket seat may allow the gasket to produce a pressure and fluidic seal between the shoulder and the polymeric block. The gasket may further provide a pressure and fluidic seal between the exiting wire and the block. The gasket may be used to orient the polymeric block within the annular groove. A similar gasket may be used to seal the end of the helical conductor that leads to ground.

The following remaining summary is taken from the prior art '177 reference.

A transmission system in a downhole component comprises a data transmission element in both ends of the downhole component. Each data transmission element houses an electrically conducting coil in a MCEI circular trough or channel. The electrically conducting coil comprises at least two generally fractional loops. In the preferred embodiment, the transmission elements are connected by an electrical conductor. Disclosed is an electrical conductor that is a coaxial cable.

Disclosed is a transmission element where the MCEI trough or cannel comprises ferrite. As a signal travels along the fractional loops a magnetic field is generated in the MCEI trough. When adjacent another transmission element, the magnetic field influences the adjacent MCEI trough to generate a magnetic field. The transmission elements may be arranged such that a magnetic transmission circuit is generated and a signal is created in the adjacent fractional loops of the coil. The at least two fractional loops may be wires. The at least two fractional loops may be insulated wires.

In the preferred embodiment, the fractional loops are connected by a connecting cable. In one aspect of the present invention, the connecting cable is a pair of twisted wires. In some embodiments of the present invention the connecting cable is a shielded pair of twisted wires. It is believed that the electromagnetic influence of the one twisted wire is cancelled out by the other twisted wire and vice versa. It is believed that a shielded pair of twisted wires would improve the shielding of electromagnetic influences from the wires. It is important that the MCEI trough is not influenced by their electromagnetic fields so that a second magnetic field is not magnified. It is believed that a strong second magnetic field would create interference in the transmission of a signal from one downhole component to an adjacent downhole component.

Disclosed is a connecting cable that is disposed outside of the MCEI circular trough. In some embodiments of the present invention, the connecting cable is disposed in a hole in the MCEI trough. Also disclosed is a connecting cable is disposed in a channel formed in the MCEI circular trough. Some embodiments include a connecting cable disposed outside an annular housing, which houses the MCEI circular trough.

In another aspect of the present invention, the connecting cable is a coaxial cable. In some embodiments the connecting cable is a triaxial cable. It is believed that the electromagnetic influence of the inner core of the coaxial cable is cancelled out by the outer shield of the coaxial cable and vice versa. It is believed that a triaxial cable would further shield the MCEI trough from the electromagnetic influences of the inner core and the shield of the coaxial cable. In another aspect of the present invention, the connecting cable is a shielded twin axial cable. In this embodiment, it is believed that the shield protects MCEI trough from the electromagnetic influences of the twin axial cable. The connecting cable may be grounded to the annular housing. In other embodiments the connecting cable is grounded to the downhole component.

The downhole component may be part of a drill string. Alternatively the downhole component may be part of a production well. The downhole component may be a pipe. In some embodiments, the downhole component may be a tool.

It should be understood that in this specification, the term "fractional loop" is intended to mean that the loop resides in 80 percent or less of the length of the MCEI circular trough.

BRIEF DESCRIPTION OF THE DRAWINGS

(Prior Art) FIG. 3 is a cross sectional view of an embodiment of a downhole tool string.

(Prior Art) FIG. 4 is a perspective cross sectional view of an embodiment of downhole components.

(Prior Art) FIG. 5 is a perspective view of an embodiment of a transmission element.

(Prior Art) FIG. 6 is a cross sectional view of an embodiment of a downhole component.

(Prior Art) FIG. 7 is an orthogonal view of an embodiment of a coil.

(Prior Art) FIG. 8 is an orthogonal view of an embodiment of a coil.

(Prior Art) FIG. 9 is a perspective view of an embodiment of a coil.

(Prior Art) FIG. 10 is an orthogonal view of an embodiment of a coil.

(Prior Art) FIG. 11 is an orthogonal view of an embodiment of a coil.

(Prior Art) FIG. 12 is an orthogonal view of an embodiment of a coil.

(Prior Art) FIG. 13 is an orthogonal view of an embodiment of a coil.

(Prior Art) FIG. 14 is an orthogonal view of an embodiment of a coil.

(Prior Art) FIG. 15 is an orthogonal view of an embodiment of a coil.

(Prior Art) FIG. 16 is a perspective cross sectional view of an embodiment of a coil.

(Prior Art) FIG. 17 is a perspective cross sectional view of an embodiment of a coil.

(Prior Art) FIG. 18 is a perspective cross sectional view of an embodiment of a coil.

(Prior Art) FIG. 19 is a perspective cross sectional view of an embodiment of a coil.

(Prior Art) FIG. 20 is a perspective cross sectional view of an embodiment of a coil.

(Prior Art) FIG. 21 is a perspective cross sectional view of an embodiment of a coil.

(Prior Art) FIG. 22 is a perspective cross sectional view of an embodiment of a coil.

(Prior Art) FIG. 23 is a perspective cross sectional view of an embodiment of a coil.

(Prior Art) FIG. 24 is a perspective cross sectional view of an embodiment of a coil.

(Prior Art) FIG. 25 is a perspective cross sectional view of an embodiment of a coil.

DETAILED DESCRIPTION OF THE PREFERRED EMBODIMENTS

Figure 1:
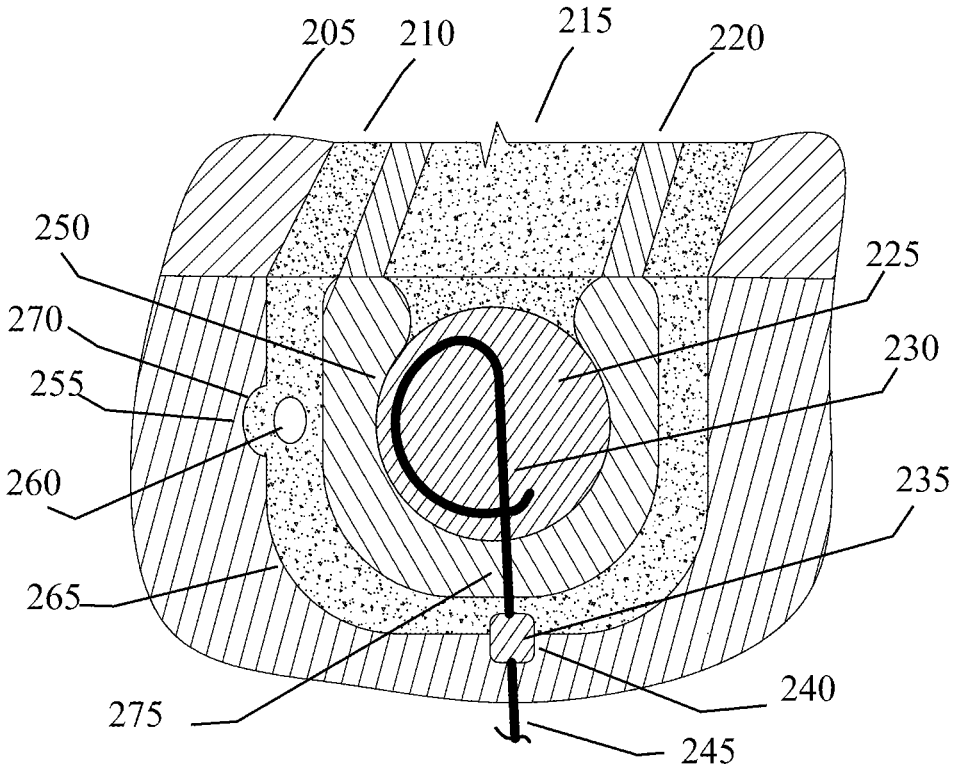
FIG. 1 is a cross sectional view of a diagram of an inductive coupler of the present invention.
Figure 2:
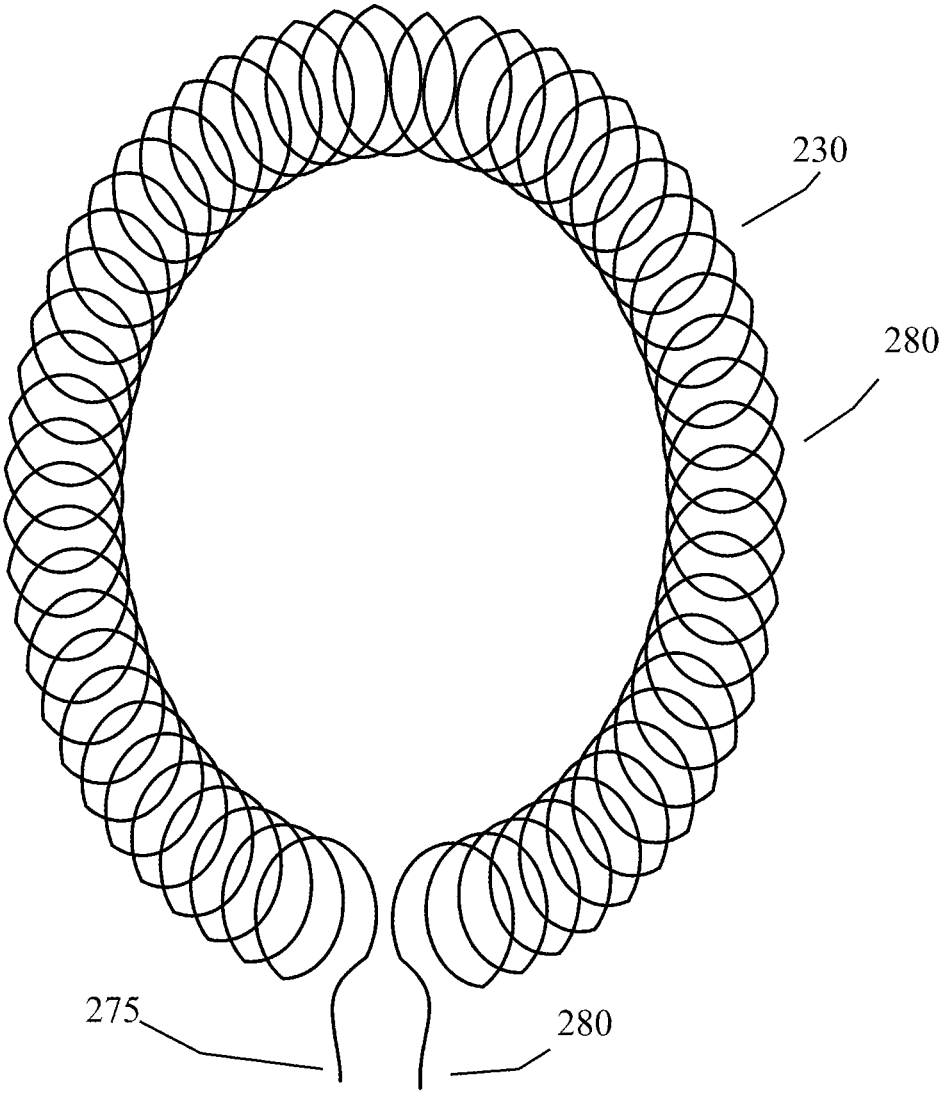
FIG. 2 is a perspective diagram of the helical coil of the present invention.

Referring to FIGS. 1 and 2, a data transmission system for wired drill pipe (WDP) is disclosed comprising a composite annular polymeric block 210 suitable for housing in an annular groove 265 in a shoulder 205 of a wired drill pipe. The composite annular polymeric block 210 may comprise an annular magnetically conductive electrically insulating (MCEI) ferrite channel or trough 220 molded therein. A helical electrical conductor 230, for example a copper wire, comprising a plurality of vertical loops 285 may be disposed within the ferrite channel or trough 220. One end of the helical electrical conductor 275 may be connected to a cable running the length of the wired drill pipe and connected to a similarly configured helical electrical conductor 230 at the opposite end of the wired drill pipe. The other end of the helical electrical conductor 280 may be connected to ground, for example the wired drill pipe shoulder 205.

The ferrite channel or trough 220 may comprise a core region 225, partially defined by the inside wall 250 of the ferrite channel 220. The ferrite channel 220 may be open on its top side 215. The core region 225 may be circular or non-circular in shape. The vertical loops 285 of the helical conductor 230 may be constrained within the core region 225. The major diameter of the vertical loops 285 may be less than the major diameter of the core region 225. The diameter of the vertical loops 285 may be equal to between ten percent and ninety percent of the diameter of the core region 225. The open portion 215 of the ferrite channel or trough 220 may be filled with a composite material. The composite material may comprise a material similar to the polymeric block 210. The top surface of the ferrite channel 220 defining the open portion 215 of the core region 225 may be exposed along the top surface 215 of the annular polymeric block 210. The plurality of vertical loops 285 may average between 2 and 60 loops 285 per linear inch of the annular ferrite channel 220 within the core region 225 of the ferrite channel 220. The annular ferrite channel 220 may house a quantity of vertical loops 285 depending on the circumference of the annular ferrite channel 220. The vertical loops 285 may comprise an insulating coating or sheath. The core region 225 may be filled with a non-electrically conducting material or the core region 225 may be devoid of a filler.

The composite polymeric block 210 may comprise a polymer selected from the group consisting of epoxy, synthetic rubber, polyurethane, silicon, a fluorinated polymer, polytetrafluoroethylene, perfluoroalkoxy, or a combination thereof. The composite polymeric block 210 may comprise a volume of particles comprising micron and submicron elements of Fe and Mn of diameters averaging between 150 nm and 2500 nm. The volume of particles may average between three percent and sixty-seven percent of the volume of the polymer.

The composite polymeric block 210 may comprise one or more protruding bumpers 270 along its longest peripheral side. Or the protruding bumper 270 may circumscribe the longest periphery of the polymeric block 210. The bumper 270 may comprise a dimple on its anterior surface. The protruding bumper 270 may be aligned with a bumper seat 255 disposed in an adjacent wall of the annular groove 265 in the drill pipe shoulder 205.

The composite polymeric block 210 may comprise one or more void openings 260 within the composite polymeric block 210. A void opening 260 within the polymeric block 210 may be located proximate the protruding bumper 270. The presence of the void opening 260 proximate the protruding bumper 270 may provide resiliency in the polymeric block 210 as the block is installed into the annular groove 265.

The composite polymeric block 210 may comprise a gasket 235. The gasket 235 may be molded into the polymeric block 210 or the gasket may be installed into the block 210 subsequent to the block's 210 formation. The gasket 235 may comprise an axial opening. The gasket 235 may protrude from the composite polymeric block 210. The axial opening may provide a pathway for the helical wire 245 to exit the polymeric block 210 on its way to connect with the cable 275. The gasket 235 may be disposed within a gasket seat 240 in the drill pipe shoulder 205 adjacent the polymeric block 210. The gasket seat 240 may allow the gasket 235 to produce a pressure and fluidic seal between the shoulder 205 and the polymeric block 210. The gasket 235 may further provide a pressure and fluidic seal between the exiting wire 245 and the block 210. In addition to providing a seal for the block 210, the gasket may be used to orient the polymeric block 210 within the annular groove 265. A similar gasket 235 may be used to seal the other end of the helical conductor 280 that leads to ground.

The following detailed description is taken from the '177 reference. The following description relates equally to FIGS. 1 and 2 except as modified and altered.

Referring to (Prior Art) FIG. 3 shows an embodiment of a downhole tool string 31 suspended in a well bore by a derrick 32. Surface equipment 33, such as a computer, connects to a data swivel 34. The data swivel 34 is adapted to transmit data to and from an integrated transmission network while the downhole tool string 31 is rotating. The integrated transmission network comprises the transmission systems of the individual components 35, 36, 57 of the downhole tool string 31. Preferably the downhole tool is a pipe 36, 57. Alternatively, the downhole component may be a tool 35. Tools 35 may be located in the bottom hole assembly 37 or along the length of the downhole tool string 31. Examples of tools 35 on a bottom hole assembly 37 comprise sensors, drill bits, motors, hammers, and steering elements. Examples of tools 35 located along the downhole tool string 31 are links, jars, seismic sources, seismic receivers, sensors, and other tools that aid in the operations of the downhole tool string 31. Different sensors are useful downhole such as pressure sensors, temperature sensors, inclinometers, thermocouples, accelerometers, and imaging devices. Preferably the downhole tool string 31 is a drill string. In other embodiments the downhole tool string 31 is part of a production well.

The downhole tool string 31 is made up of components, as shown in (Prior Art) FIG. 3. Preferably the components are pipes 36, 57 or some of the above mentioned tools 35. The components comprise data transmission elements 38, 47 located in the secondary shoulder 39 of the pin end 40 and the secondary shoulder 41 of the box end 42 of the downhole component 36, 57. Preferably, the transmission elements 38, 47 comprise an MCEI circular trough 46 (shown in (Prior Art) FIG. 5), which is disposed in an annular groove formed in the secondary shoulders 39, 41. More preferably the annular grooved is formed by an annular housing 43. The annular housing 43 may be a metal ring. Preferably, the annular housing 43 is a steel ring. In other embodiments the annular housing 43 may be a stainless steel ring. The data transmission elements 38, 47 are connected by an electrical conductor 44. Preferably the electrical conductor 44 is a coaxial cable 96.

As shown, the MCEI circular trough 46 houses an electrically conductive coil 45. Preferably the MCEI trough is made from a single MCEI material, such as ferrite. The MCEI material may also be soft iron, nickel iron alloys, silicon iron alloys, cobalt iron alloys or mu-metals.

Alternatively, the MCEI trough may be of a combination of materials, such as a magnetizable element comprising a multi-laminar body. The element may comprise a plurality of ductile, generally U-shaped leaves that are electrically conductive. The leaves are less than about 0.0625" thick and are separated by an electrically insulating material. These leaves are aligned so as to form a generally circular trough. The permeable and ductile material may be associated with the class of soft magnetic materials.

The coil 45 may comprises at least two fractional loops 67, 70 of insulated wire. Preferably, the wire is made of copper and is insulated with a varnish, an enamel, or a polymer. When the components of the downhole tool string 31 are made up, the transmission elements 38, 47 line up adjacent to each other and allow data transmission between components 36, 57. A threaded portion 48 located between the primary shoulder 49 and secondary shoulder 39 of the pin end 40 and a threaded portion 50 located between the primary shoulder 51 and secondary shoulder 41 of the box end 42 provide a means of attachment for the downhole components 36, 57.

(Prior Art) FIG. 5 shows an embodiment of a connection between the electrical conductor 44 and the electrical conducting coil 45. In the preferred embodiment, a signal travels along the electrical conductor 44 of a downhole component 36. The signal passes from the electrical conductor 44 to a lead wire 52 of the coil 45. The transmission element 38 comprises an anti-rotation device 53, which keeps the annular housing 43 from rotating about the axis of the lead wire 52. In the preferred embodiment the lead wire 52 may enter the annular housing 43 through a hole in the annular housing 43, where there is a void 54 of the MCEI trough. The coil 45 is housed in a channel 55 formed by the MCEI circular trough 46.

Preferably, the fractional loops may be equal in length, for example: two half loops, three third loops, and four quarter loops. In the preferred embodiment, the coil comprises two half loops. Alternatively, the fractional loops may be different lengths, for example: one half loop combined with two quarter loops, and one third loop combined with one three quarter loop.

In the preferred embodiment, a connecting cable 66 times the arrival of the electrical signals to the fractional loops of the coil 45. In the preferred embodiment a first fractional loop 67 extends halfway around the channel 55 where it makes a first contact 69 with the connecting cable 66 which leads to ground. The connecting cable 66 makes a second contact 68 with the first fractional loop 67 where the lead wire 52 enters the annular housing 43. The second contact 68 creates a second signal, which is passed along the connecting cable 66. The second signal arrives at a second fractional loop 70 approximately at the same time as the first signal arrives at the first contact 69. It believed that approximately as the first signal leaves the channel 55, the second signal enters the channel 55 and the coil 45 experiences a continuous circuit. The second fractional loop 70 is preferably grounded to the annular housing 43 in the void 54 in the MCEI trough. In the preferred embodiment, the grounded portion 56 of the coil 45 is brazed to the annular housing 43. In some embodiments of the present invention the coil 45 and MCEI circular trough 46 are disposed in a groove formed by the secondary shoulders 39, 41 of both the pin end 40 and also of the box end 42 of the downhole component 36.

As the signal travels along the fractional loops 67, 70 of the coil 45, the magnetic field from the electrical current is magnified by the MCEI trough. The magnified magnetic field influences the MCEI trough in the adjacent transmission element 47 in the adjacent downhole component 57. Preferably, the electrically conducting coils are arranged in a manner to allow the magnetic fields to generate a magnetic transmission circuit. A magnetic transmission circuit may be allowed by disposing one coil in a clockwise direction in the MCEI circular trough 46 and disposing an adjacent coil in a counterclockwise direction in an adjacent segmented circular trough 46 of MCEI trough. The coil in the adjacent transmission element 47 is influenced by the magnetic transmission circuit to generate an electrical current and that signal is passed to the electrical conductor 58 in the adjacent downhole component 57. It is believed that the fractional loops 67, 70 reduce the inductance of the electrically conducting coil 45. It is further believed that the reduced inductance reduces impedance reflections; therefore, the reduced inductance reduces signal loss and attenuation.

In the preferred embodiment, a passage 59 is formed in the component 36 for the electrical conductor 44 and lead wire 52. Preferably the passage 59 runs from the secondary shoulder 39 to an opening 60 in the inner diameter 61 of the downhole component 36. The passage 59 may be a drilled hole. (Prior Art) FIG. 6 shows an embodiment of the coaxial cable 96 disposed inside the downhole component 36. In the preferred embodiment the inner diameter 61 of the downhole component 61 narrows at the ends of the component 36. The coaxial cable 96 exits the passage 59 through the opening 60 in the region 63 where the inner diameter 61 of the component 36 narrows. The coaxial cable comprises a conductive core 64, and dielectric 65, and a conductive shield 62.

(Prior Art) FIG. 7 shows an embodiment of a coil 45. Preferably, the connecting cable 66 is approximately the same length as the fractional loops 67, 70. More preferably, the electrical characteristics of the connecting cable 66 are similar to the electrical characteristics of the fractional loops 67, 70. It is believed that a connecting cable 66 of similar length and similar electrical characteristics to the fractional loops 67, 70 may carry signals at the same velocity. In certain embodiments of this invention, the electrical characteristics and the length of the connecting cable 66 and the fractional loops 67, 70 are different, but they are arranged such that as the first signal passes out of the channel 55, the second signal passes into the channel 55. It is also preferred that the fractional loops 67, 70 are approximately equal in length and have similar electrical characteristics.

The connecting cable 66 may a pair of twisted wires 71, 72. The connecting cable 66 may alternatively be a shielded pair 79 of twisted wires 71, 72. In another aspect of the present invention, the connecting cable 66 is a coaxial cable 74. Alternatively, the connecting cable 66 is a triaxial cable 80. In another aspect of the present invention, the connecting cable 66 is shielded twin axial cable 81. (Prior Art) FIG. 7 shows an embodiment of a pair of twisted wires 71, 72 as the connecting cable 66. Wire 71 makes the second contact 68 and wire 72 make the first contact 69. It is believed that the electromagnetic influence of wire 71 is cancelled out by the opposite electromagnetic influence of wire 70 and vice versa. It is believed that a shielded pair 79 of twisted wires 71, 72 may provide a shielding effect of any electromagnetic influences of wires 71, 72. (Prior Art) FIG. 8 shows an embodiment of a connecting cable 66 comprising a coaxial cable 74. The inner core 73 of the coaxial cable 74 may make the second contact 68 and the outer shield 75 of the coaxial cable 74 may make the first contact 69. It is believed that the inner core 73 cancels out the opposite electromagnetic influences of the outer shield 75 and vice versa. It is believed that a triaxial cable 80 may provide a shielding of any electromagnetic influences of inner core 73 and the outer shield 75. (Prior Art) FIG. 9 shows a perspective view of a coil 45.

In (Prior Art) FIGS. 7, 8, and 9 the fractional loops 67, 70 are half of a full loop. It is believed that the half loops have half the inductance that a full loop may have. It is believed that the fraction of inductance of a coil with fractional loops of equal distance may be determined in relation to a full loop coil by the following equation: L=1/n.sup.2., wherein L represents inductance and n is the number of fractional loops. According to the equation, a coil 45 comprising two half loops 67, 70 would have ¼ the inductance. A coil 45 with three equal fractional loops would have ⅑ the inductance. A coil 45 with four equal fractional loops 82, 83, 84, 85 (shown in (Prior Art) FIG. 10) would have 1/16 the inductance. It is believed that the reduced inductance is made up in the reduced impedance reflections, which is believed to cause signal loss and attenuation.

An embodiment of a coil 45 with four fractional loops 82, 83, 84, 85 of equal length is shown in (Prior Art) FIGS. 10, 11, 12, 13, and 14. A pair of twisted wires 71, 72 is used as the connecting cable 66. The lead wire 52 makes a first contact 86 with the first fractional loop 82 and a second contact 87 with wire 71. (Prior Art) FIG. 10 highlights the pathways for the three signals produced during a first interval of time. (Prior Art) FIG. 11 shows the pathway for the three signals during a second interval. The signal traveling on the first fractional loop 82 makes a contact 88 with wire 72 and then travels to ground 89. The a first signal on wire 71 make a contact 90 with the second fractional loop 83. A second signal on wire 71 continues to travel to a contact 91 with the third fractional loop 84. (Prior Art) FIG. 12 shows the contact 91 between the third fractional loop 83 and wire 71, which the signal passes during a third interval. The second fractional loop 83 makes a contact 92 with wire 72. (Prior Art) FIG. 13 shows a fourth interval of time. One signal passes from the third fractional loop to wire 72 at contact 93, and the signal travels to ground 89. A signal from wire 72 travels to the fourth fractional loop 85 at contact 94 and that signal travels to ground 89. The three signals allow the coil 45 to experience a continuous circuit with approximately no time interruptions. Further the four fractional loops 82, 83, 84, 85 reduce to the inductance of the coil 45 and may improve impedance matching between a transmission element 38 to an adjacent transmission element 47 or between the coil 45 and the electrical conductor 44.

(Prior Art) FIG. 14 shows another embodiment of four fractional loops 82, 83, 84, 85 of equal length. The connecting cable 66 comprises three segments 95 of coaxial cable 74.

(Prior Art) FIG. 15 shows an embodiment of a coil 45 with a full loop 76, a first fractional loop 67, and a second fractional loop 70. In this embodiment the connecting cable 66 makes a first contact 68 and a second contact 69. The signal enters through the hole in the annular housing 43 and travels around the segmented circular trough 46 forming a full loop 76. The first contact 68 is located at the end of the full loop 67 where a second signal travels up the connecting cable 66. The first signal travels along the first fractional loop 67 as the second signal travels along the connecting cable 66. The first signal reaches the second contact 68 and the signal goes to ground at the same time that the second signal reaches the second fractional loop 70.

(Prior Art) FIGS. 16-25 show fractional perspective views of the coil 45 and the connecting cable 66 fitted in the MCEI circular trough 46. (Prior Art) FIG. 16 shows a hole 78 located in the MCEI trough, where a pair of twisted wires 71, 72 runs. It is believed that in this embodiment the electromagnetic influences of the pair of twisted wires 71, 72 are cancelled out by each other and will provide a minimal affect on the MCEI trough. The connecting cable 66 may be located below the MCEI trough; an embodiment is shown in (Prior Art) FIG. 17. In this embodiment, a gap 100 between the MCEI trough and the annular housing 43 is formed to make room for connecting cable 66. It is believed that the gap 100 has a minimal impact on the magnetic transmission circuit.

(Prior Art) FIG. 18 shows an embodiment of a connecting cable 66 located between the annular housing 43 and the MCEI trough. In another aspect of the present invention, the connecting cable 66 is located outside the annular housing 43; an embodiment is shown in (Prior Art) FIG. 19. In this embodiment the connecting cable 66 is heavily shielded from the MCEI trough. A niche may be removed from the annular groove formed in the downhole component 36 where the annular housing 43 resides to make room for the connecting cable 66. In some embodiments, the connecting cable 66 is located outside of the inner diameter 97 of the annular housing 43. It is believed that this embodiment is advantageous, because a shorter connecting cable 66 may be used. In other embodiments the connecting cable 66 is located outside the outer diameter 98 of the annular housing 43. (Prior Art) FIG. 20 shows another embodiment of a connecting cable 66 located below the annular housing 43. This embodiment is believed to be advantageous because the niche may be removed under the annular housing 43. In some embodiments the connecting cable 66 may be used to help bias the transmission element 38 up and provide better contact with an adjacent transmission element 47.

In another aspect of the invention, a bend 99 is made in the annular housing 43 to provide a place for the connecting cable 66; an embodiment is shown in (Prior Art) FIG. 21. (Prior Art) FIGS. 22 and 23 show similar embodiments to the embodiments shown in (Prior Art) FIGS. 18 and 19, wherein the connecting cable 66 is a coaxial cable 74.

(Prior Art) FIGS. 24 and 25 show embodiments of the connecting cable 66 located in the channel 55 with a fractional loop 67. An electrically insulating filler material 77 fills the space around the connecting cable 66 and the coil 45 in the channel 55. The filler material 77 helps to isolate the electrical influences of the connecting cable 66. It is important that the electromagnetic influences of the connecting cable 66 are isolated so it does not create a magnetic field that may adversely affect the magnetic transmission circuit. Preferably, the filler material 77 is selected from a group consisting of epoxy, natural rubber, fiberglass, carbon fiber composite, a polymer, polyurethane, silicon, a fluorinated polymer, grease, polytetraflouoethyene and perfluoroalkoxy, or a combination thereof.

The description above and the attached figures are meant to illustrate specific embodiments of the present invention and not limit its scope. Those having ordinary skill in the art will appreciate that other embodiments will fall within the scope and spirit of the invention as defined in the appended claims.

I claim:

1. A data transmission system, comprising a composite annular polymeric block suitable for housing in an annular groove in a shoulder of a drill pipe;

the composite annular polymeric block comprising an annular magnetically conductive electrically insulating ferrite channel molded therein;

a helical electrical conductor comprising a plurality of vertical loops electrically grounded to the shoulder is disposed within the ferrite channel, and wherein the helical electrical conductor is connected to a cable running the length of the drill pipe and connected to a similarly configured helical electrical conductor at the opposite end of the drill pipe.

2. The data transmission system of claim 1, wherein the ferrite channel comprises a core region.

3. The data transmission system of claim 2, wherein the plurality of vertical loops average between 2 and 60 loops per inch within the core region of the ferrite channel.

4. The data transmission system of claim 2, wherein the vertical loops are encased within an electrically insulating compound within the core region of the ferrite channel.

5. The data transmission system of claim 2, wherein a major diameter of the vertical loops is less than a major diameter of the core region of the ferrite channel.

6. The data transmission system of claim 2, wherein a major diameter of the vertical loops is between ten percent and ninety percent of a major diameter of the core region of the ferrite channel.

7. The data transmission system of claim 2, wherein the core region of the ferrite channel is open.

8. The data transmission system of claim 1, wherein the ferrite channel comprises a circular core region.

9. The data transmission system of claim 1, wherein the ferrite channel comprises a non-circular core region.

10. The data transmission system of claim 1, wherein the composite polymeric block comprises a polymer selected from the group consisting of epoxy, synthetic rubber, polyurethane, silicon, a fluorinated polymer, polytetrafluoroethylene, perfluoroalkoxy, or a combination thereof.

11. The data transmission system of claim 1, wherein the composite polymeric block comprises a volume of particles comprising micron and submicron elements of Fe and Mn of between three percent and sixty-seven percent of the volume of polymer.

12. The data transmission system of claim 1, wherein the composite polymeric block comprises a protruding bumper.

13. The data transmission system of claim 12 wherein a void opening within the polymeric block is located proximate the protruding bumper.

14. The data transmission system of claim 1, wherein the annular groove comprises a bumper seat.

15. The data transmission system of claim 1, wherein the composite polymeric block comprises one or more void openings within the composite polymeric block.

16. The data transmission system of claim 1, wherein the helical electrical conductor comprises an electrically insulated conductive wire.

17. The data transmission system of claim 1, wherein the composite polymeric block comprises a gasket molded therein.

18. The data transmission system of claim 17, wherein the gasket protrudes from the composite polymeric block.

19. The data transmission system of claim 17, wherein the gasket is suitable for sealing disposition within a gasket seat in the annular groove of the drill pipe shoulder.

20. The data transmission system of claim 17, wherein the gasket comprises a sealed pathway for the helical electrical conductor to exit the polymeric block and the annular groove.

* * * * *